US009862521B2

(12) United States Patent
Costanzo, Jr.

(10) Patent No.: US 9,862,521 B2
(45) **Date of Patent: *Jan. 9, 2018**

(54) DUAL HANDLE COOLER BOX DESIGN, BLANK AND METHODS

(71) Applicant: THATBOX DESIGN, LLC, Fort Mill, SC (US)

(72) Inventor: Donn J. Costanzo, Jr., Fort Mill, SC (US)

(73) Assignee: THATBOX DESIGN, LLC, Fort Mill, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/357,892

(22) Filed: Nov. 21, 2016

(65) Prior Publication Data

US 2017/0066553 A1 Mar. 9, 2017

Related U.S. Application Data

(63) Continuation of application No. 14/700,107, filed on Apr. 29, 2015, now Pat. No. 9,499,294.

(60) Provisional application No. 61/985,830, filed on Apr. 29, 2014.

(51) Int. Cl.

| | |
|---|---|
| ***B65D 5/46*** | (2006.01) |
| ***B31B 1/26*** | (2006.01) |
| ***B65D 5/42*** | (2006.01) |
| ***B65D 5/24*** | (2006.01) |
| ***B65D 5/468*** | (2006.01) |
| ***B65D 5/56*** | (2006.01) |
| *B31B 50/26* | (2017.01) |
| *B31B 100/00* | (2017.01) |

(52) U.S. Cl.

CPC ..... *B65D 5/46112* (2013.01); *B65D 5/241* (2013.01); *B65D 5/4266* (2013.01); *B65D 5/4608* (2013.01); *B65D 5/4612* (2013.01); *B65D 5/563* (2013.01); *B31B 50/26* (2017.08); *B31B 2100/0024* (2017.08)

(58) Field of Classification Search

CPC .. B65D 5/241; B65D 5/4608; B65D 5/46112; B65D 5/563; B65D 5/3678; B65D 81/38; B31B 1/76; B31B 1/26; F25D 3/08; F25D 3/06

USPC ..... 229/117.14, 186, 117.06, 138, 920, 114, 229/117.01, 190; 206/163, 169, 427; 493/311; 62/457.5, 371, 457.1, 457.7, 62/464

See application file for complete search history.

(56) References Cited

U.S. PATENT DOCUMENTS

2004/0031842 A1* 2/2004 Westerman ..... B65D 5/2057 229/117.06

* cited by examiner

*Primary Examiner* — Christopher Demeree
(74) *Attorney, Agent, or Firm* — Tillman Wright, PLLC; Chad D. Tillman

(57) ABSTRACT

Dual handle box designs, blanks for forming boxes by folding, collapsible and non-collapsible boxes formed thereby, and manufacturing methods therefor are disclosed. Preferably each handle is located on an opposite end of the box; is two-ply; defines an elongate hand opening for receiving fingers of a hand; defines an elongate tab opening for receiving a tab of a center handle, and that intersects the hand opening; and defines a recess for receiving and retaining a lid panel of the box. Furthermore, the boxes preferably have a waterproof or water-resistant coating applied and are used as ice coolers for beverages and food items.

21 Claims, 4 Drawing Sheets

DUAL HANDLE COOLER BOX DESIGN, BLANK AND METHODS

CROSS-REFERENCE TO RELATED APPLICATION

The present application is a continuation of U.S. patent application Ser. No. 14/700,107, filed Apr. 29, 2015, now U.S. Pat. No. 9,499,294, which '107 application is a non-provisional of, and claims the benefit under 35 U.S.C. §119(e) to, U.S. provisional patent application 61/985,830 filed Apr. 29, 2014, which is hereby incorporated herein by reference in its entirety. Furthermore, the disclosure of the priority provisional patent application is found in the Appendix attached hereto, which is incorporated by reference.

COPYRIGHT STATEMENT

All of the material in this patent documents is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to box designs, blanks for forming boxes by folding, collapsible and non-collapsible boxes formed thereby, and manufacturing methods therefor. Preferably boxes of the invention are used as disposable coolers and are formed from cardboard to which is applied a water-resistant or waterproof coating. An exemplary disposable cooler is disclosed, for example, in Costanzo U.S. Pat. No. 8,573,430. Even in view of the foregoing, it is believed that need continues to exist for improvements and variations to such box designs, blanks, and boxes. One or more aspects and features of the present invention are believed to address such need.

SUMMARY OF THE INVENTION

The present invention includes many aspects and features. Moreover, while many aspects and features relate to, and are described in, the context of disposable ice coolers, the present invention is not limited to only such coolers and applies to other types and uses of boxes, as will become apparent from the following summaries and detailed descriptions of aspects, features, and one or more embodiments of the present invention.

Accordingly, a first aspect of the invention comprises a box as shown and described herein.

Another aspect of the invention comprises an assembled box as shown and described herein.

Another aspect of the invention comprises an assembled, collapsible box as shown and described herein.

Another aspect of the invention comprises a box in the form of a blank as shown and described herein.

Another aspect of the invention comprises a method of making any of the foregoing.

Another aspect of the invention comprises a method of assembling any of the foregoing boxes.

Another aspect of the invention comprises a method of collapsing and storing any of the foregoing.

In another aspect of the invention, a box comprises a center handle for grasping and carrying of the box using a single hand, and further comprises end handles for grasping and carrying of the box by two hands.

In another aspect of the invention, a box is formed from folding a single sheet of material having fold lines therein. In this aspect, the assembled box comprises: a bottom panel defined by subpanels; a first end panel defined by subpanels; a second, opposite end panel defined by subpanels; a first side panel; a second, opposite side panel; a first corner panel defined by subpanels; a second corner panel defined by subpanels; a third corner panel defined by subpanels; a fourth corner panel defined by subpanels; a first tab-lock and counterbalancing handle panel defined by subpanels; a second tab-lock and counterbalancing handle panel defined by subpanels; a first lid panel; a second lid panel; and a center handle panel defined by subpanels.

In various possible features of this aspect, some of which may or may not be mutually exclusive: the first and the second tab-lock and counterbalancing handle panels collectively define two-ply handles on opposite ends of the box for gripping the box, which handles are provided both when the box is in the open and closed positions; the handles are equally spaced relative to a center of the box for counterbalancing torques that result from supporting the box at two spaced apart locations; the end handles are defined respectively by openings in the subpanels connected directly to—and respectively separated by a fold line from—corner subpanels; handle subpanels define a single, two-ply handle located along the center of the box when the box is in the closed position; handle subpanels define curved tabs which align and define two-ply tabs that are received within openings defined in the end handles when the box is in the closed position, thereby locking the box in the closed position; when the box is assembled and in the open or closed positions, the openings in corner subpanels are elongate and generally extend longitudinally in a direction that is orthogonal to the openings defined therein for receiving the tabs, which openings also are elongate; when the box is assembled and in the open or closed positions, the hand openings defined by the corner subpanels extend generally orthogonally to the tab openings defined by the corner subpanels; the hand openings and the tab openings defined by the corner subpanels intersect and bisect each other.

In yet an additional feature, the box is collapsible even though it is in an assembled state by folding the box along an axis bisecting the bottom panel and the opposite end panels.

BRIEF DESCRIPTION OF THE DRAWINGS

One or more preferred embodiments of the present invention now will be described in detail with reference to the accompanying drawings.

DETAILED DESCRIPTION

Figure 1:
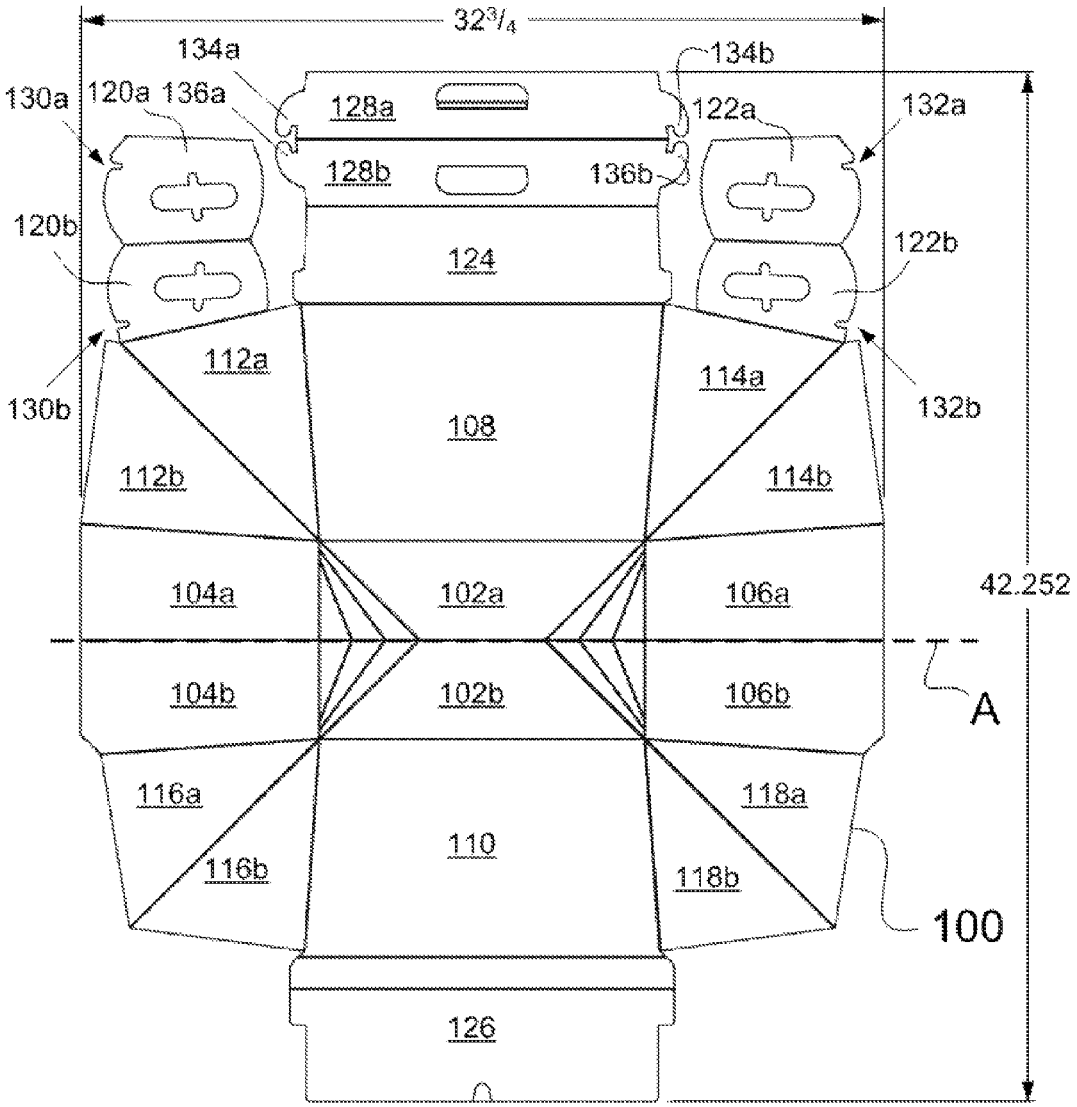
FIG. 1 is a plan view of a box blank in an unassembled, flat condition in accordance with one or more aspects and features of the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims upon issuance rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112 subsection (f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, a first preferred embodiment of a box in accordance with one or more aspects and features of the invention is represented by a box blank 100 shown in FIG. 1 in plan view in an unassembled, flat condition.

The blank 100 includes fold lines comprising score lines or areas of reduced thickness or weakness that facilitate folding of the blank during assembly of the box. The fold lines in the blank 100 serve to define discrete panels, including: a bottom panel defined by subpanels 102*a*,102*b*; a first end panel defined by subpanels 104*a*,104*b*; a second, opposite end panel defined by subpanels 106*a*,106*b*; a first side panel 108; a second, opposite side panel 110; a first corner panel defined by subpanels 112*a*,112*b*; a second corner panel defined by subpanels 114*a*,114*b*; a third corner panel defined by subpanels 118*a*,118*b*; a fourth corner panel defined by subpanels 116*a*,116*b*; a first tab-lock and counterbalancing handle panel defined by subpanels 120*a*,120*b*; a second tab-lock and counterbalancing handle panel defined by subpanels 122*a*,122*b*; a first lid panel 124; a second lid panel 126; and a center handle panel defined by subpanels 128*a*,128*b*.

Figure 2:
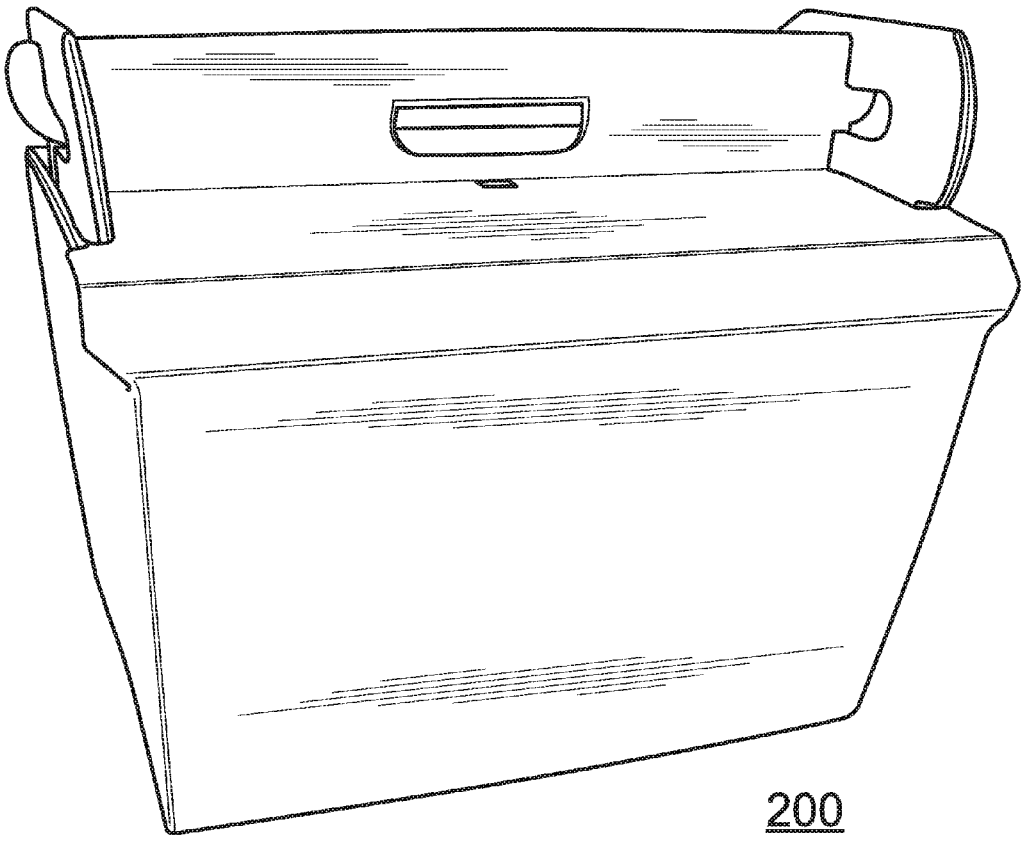
FIG. 2 illustrates a box that has been assembled by folding the box blank of FIG. 1, wherein the assembled box is in a closed configuration.

FIG. 2 illustrates a box 200 that has been assembled by folding the box blank 100 of FIG. 1 along fold lines, wherein the box 200 is in a closed configuration. The assembled box 200 preferably includes a waterproof or water-resistant coating on the interior surfaces such that the box may be used for containing ice, beverages, and food within an interior cooler space thereof.

As seen in box 200, the first tab-lock and counterbalancing handle panel defined by subpanels 120*a*,120*b* and the second tab-lock and counterbalancing handle panel defined by subpanels 122*a*,122*b* collectively define two-ply handles on opposite ends of the box 200 for gripping the box 200. These handles are provided both when the box 200 is in the open and closed positions. The handles are equally spaced relative to a center of the box for counterbalancing torques that result from supporting the box at two spaced apart locations. It will further be appreciated that these handles are defined respectively by openings in the subpanels 120*a*,120*b* connected directly to—and separated by a fold line from—subpanel 112*a*, and in the subpanels 122*a*,122*b* connected directly to—and separated by a fold line from—subpanel 114*a*.

Figure 3:
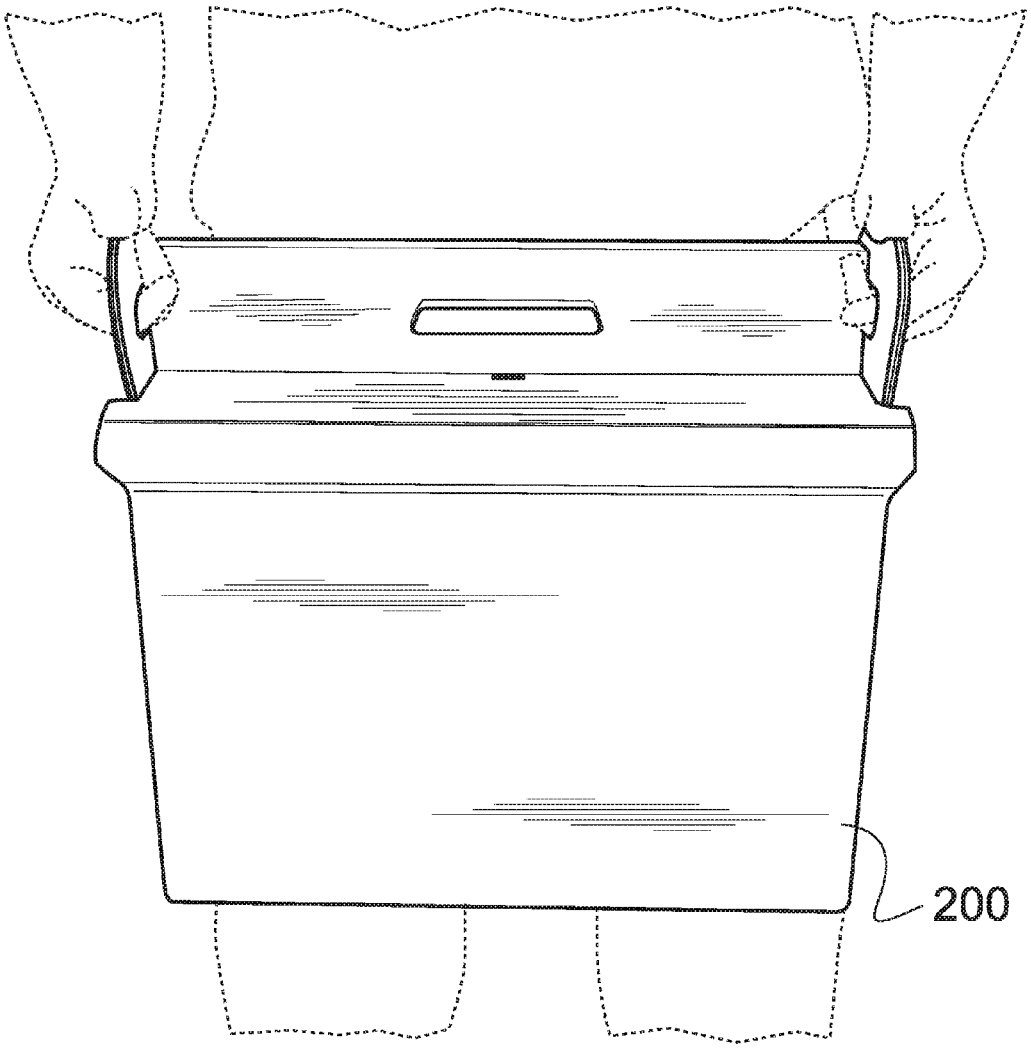
FIG. 3 illustrates a method of gripping and carrying the box using two handles defined on opposite ends of the box of FIG. 2.

FIG. 3 illustrates a method of gripping and carrying the box 200 using the two handles defined on opposite ends of the box 200.

As further seen in the drawings, subpanels 120*a*,120*b* define notches 130*a*,130*b* that align when these subpanels are folded relative to each other to form a first handle, whereby these notches define a first recess in the first handle for receiving and retaining lid panel 126 when the box 200 is in the closed position. Similarly, subpanels 122*a*,122*b* define notches 132*a*,132*b* that align when these subpanels are folded relative to each other to form a second handle, whereby these notches define a second recess in the second handle for receiving and retaining lid panel 126 when the box 200 is in the closed position. These recesses operate to hold and retain the lid 126 in the closed position of the box 200 with the lid 126 being inserted into the recesses.

Figure 4:
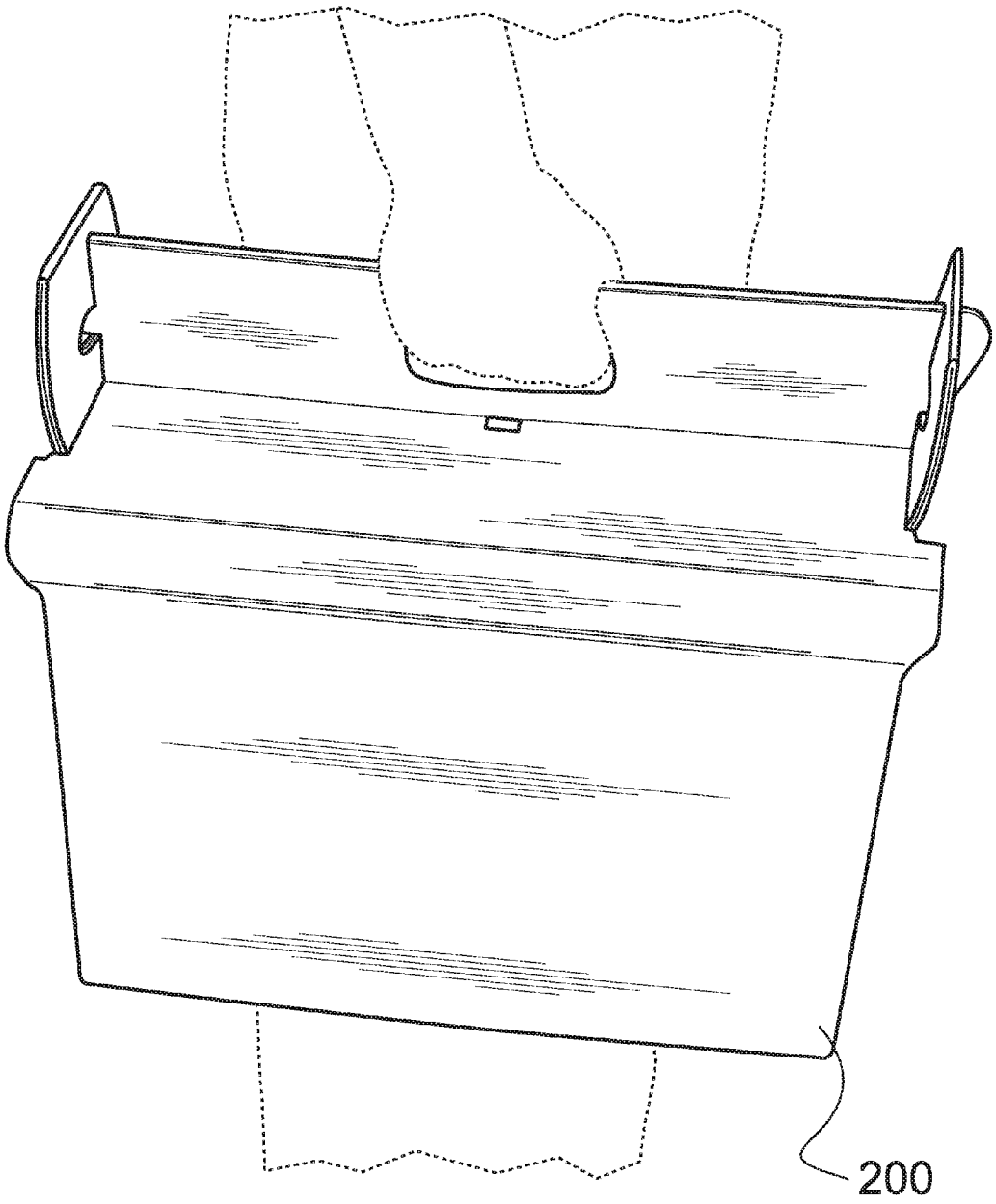
FIG. 4 illustrates an alternative method of gripping and carrying the box using a single handle defined at a centered location of the box of FIG. 2.

As further seen in the drawings, subpanels 128*a*,128*b* define a single, two-ply handle located along the center of the box 200 when the box 200 is in the closed position. FIG. 4 illustrates an alternative method of gripping and carrying the box using this single handle.

Additionally, subpanels 128*a*,128*b* further define curved tabs 134*a*,134*b* and 136*a*,136*b* which align and define two-ply tabs that are received within openings defined in the end handles when the box 200 is in the closed position, thereby locking the box 200 in the closed position. When the box 200 is assembled and in the open or closed positions, the openings in subpanels 120*a*,120*b*,122*a*,122*b* are elongate and generally extend longitudinally in a direction that is orthogonal to the openings defined therein for receiving the tabs, which openings also are elongate. In other words, the hand openings preferably extend generally orthogonally to the tab openings. Moreover, the two types of openings preferably intersect each other and, more preferably, bisect each other.

It will be appreciated that the blank 100 further is designed to form, when assembled, a box that is collapsible even though it is in an assembled state by folding the box 200 along axis A shown in FIG. 1, which axis bisects the bottom panel and the opposite end panels.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A box comprising a single sheet of material having fold lines therein defining panels, the single sheet of material comprising:

(a) a bottom panel;

(b) a first end panel connected directly to the bottom panel;

(c) a second end panel located opposite the first end panel and connected directly to the bottom panel;

(d) a first side panel connected directly to the bottom panel;

(e) a second side panel located opposite the first side panel and connected directly to the bottom panel;

(f) a first corner panel defined by two subpanels connected directly together along and separated by a fold line, one of the subpanels of the first corner panel connected directly to the first side panel along and separated by a fold line, and the other of the subpanels of the first corner panel connected directly to the first end panel along and separated by a fold line;

(g) a second corner panel defined by two subpanels connected directly together along and separated by a fold line, one of the subpanels of the second corner panel connected directly to the first side panel along and separated by a fold line, and the other of the subpanels of the second corner panel connected directly to the second end panel along and separated by a fold line;

(h) a third corner panel defined by two subpanels connected directly together along and separated by a fold line, one of the subpanels of the third corner panel connected directly to the second side panel along and separated by a fold line, and the other of the subpanels of the third corner panel connected directly to the second end panel along and separated by a fold line;

(i) a fourth corner panel defined by two subpanels connected directly together along and separated by a fold line, one of the subpanels of the fourth corner panel connected directly to the second side panel along and separated by a fold line, and the other of the subpanels of the fourth corner panel connected directly to the first end panel along and separated by a fold line;

(j) a first tab-lock and counterbalancing handle panel defined by two subpanels connected directly together along and separated by a fold line, one of the subpanels of the first tab-lock and counterbalancing handle panel connected directly to the first corner panel along and separated by a fold line;

(k) a second tab-lock and counterbalancing handle panel defined by two subpanels connected directly together along and separated by a fold line, one of the subpanels of the second tab-lock and counterbalancing handle panel connected directly to the second corner panel along and separated by a fold line;

(l) a first lid panel connected directly to the first side panel;

(m) a second lid panel connected directly to the second side panel; and (n) a center handle panel defined by two subpanels connected directly together along and separated by a fold line, one of the subpanels of the center handle panel connected directly to the first lid panel along and separated by a fold line, the center handle panel having tabs located on opposite ends thereof;

(o) wherein the two subpanels of the first tab-lock and counterbalancing handle panel define a first two-ply handle for gripping the box at a first end of the box and the two subpanels of the second tab-lock and counterbalancing handle panel define a second two-ply handle for gripping the box at a second end of the box opposite to the first two-ply handle at the first end of the box, the first and second two-ply handles defining openings configured to receive fingers and the tabs of the center handle panel.

2. The box of claim 1, wherein each of the first and second two-ply handles defines a hand opening configured to receive fingers of a hand and defines a tab opening configured to receive one of the tabs of the center handle panel.

3. The box of claim 2, wherein each hand opening is elongate and each tab opening is elongate.

4. The box of claim 2, wherein the hand opening and the tab opening of the first two-ply handle are elongate and generally extend orthogonal to each other, and wherein the hand opening and the tab opening of the second two-ply handle are elongate and generally extend orthogonal to each other.

5. The box of claim 2, wherein the hand opening and the tab opening of the first two-ply handle intersect each other, and wherein the hand opening and the tab opening of the second two-ply handle intersect each other.

6. The box of claim 2, wherein the hand opening and the tab opening of the first two-ply handle bisect each other, and wherein the hand opening and the tab opening of the second two-ply handle bisect each other.

7. The box of claim 2, wherein the subpanels of the first two-ply handle panel define notches that align when the subpanels are folded relative to each other to form the first two-ply handle, the aligned notches forming a recess for receiving and retaining the second lid panel on the first end of the box when the box is in a closed position; and wherein the subpanels of the second two-ply handle panel define notches that align when the subpanels are folded relative to each other to form the second two-ply handle, the aligned notches forming a recess for receiving and retaining the second lid panel on the second, opposite end of the box when the box is in the closed position.

8. The box of claim 1, wherein the subpanels of the first two-ply handle panel define notches that align when the subpanels are folded relative to each other to form the first two-ply handle, the aligned notches forming a recess for receiving and retaining the second lid panel on the first end of the box when the box is in a closed position; and wherein the subpanels of the second two-ply handle panel define notches that align when the subpanels are folded relative to each other to form the second two-ply handle, the aligned notches forming a recess for receiving and retaining the second lid panel on the second, opposite end of the box when the box is in the closed position.

9. The box of claim 1, wherein the bottom panel is defined by two subpanels connected directly together along and separated by a fold line.

10. The box of claim 1, wherein the second end panel is defined by two subpanels connected directly together along and separated by a fold line.

11. The box of claim 1, wherein a subpanel of the first corner panel and a subpanel of the fourth corner panel are adhered to the first end panel, and wherein a subpanel of the second corner panel and a subpanel of the third corner panel are adhered to the second end panel, to form an assembled configuration of the box.

12. The box of claim 1, wherein the handles are equally spaced relative to a center of the box for counterbalancing torques that result from supporting the box by the first and second two-ply handles.

13. The box of claim 1, wherein the subpanels of the center handle panel define a single, two-ply handle located along a center line of the box when the box is in an assembled configuration in a closed position.

14. The box of claim 1, wherein the box is collapsible when the box is in an assembled configuration by folding the box along fold lines aligned along an axis that bisects the bottom panel and the opposite end panels of the box.

15. A method of assembling a box from a single sheet of material having fold lines therein defining panels, comprising the steps of:

(I) providing a box blank comprising (a) a bottom panel;

(b) a first end panel connected directly to the bottom panel;

(c) a second end panel located opposite the first end panel and connected directly to the bottom panel;

(d) a first side panel connected directly to the bottom panel;

(e) a second side panel located opposite the first side panel and connected directly to the bottom panel;

(f) a first corner panel defined by two subpanels connected directly together along and separated by a fold line, one of the subpanels of the first corner panel connected directly to the first side panel along and separated by a fold line, and the other of the subpanels of the first corner panel connected directly to the first end panel along and separated by a fold line;

(g) a second corner panel defined by two subpanels connected directly together along and separated by a fold line, one of the subpanels of the second corner panel connected directly to the first side panel along and separated by a fold line, and the other of the subpanels of the second corner panel connected directly to the second end panel along and separated by a fold line;

(h) a third corner panel defined by two subpanels connected directly together along and separated by a fold line, one of the subpanels of the third corner panel connected directly to the second side panel along and separated by a fold line, and the other of the subpanels of the third corner panel connected directly to the second end panel along and separated by a fold line;

(i) a fourth corner panel defined by two subpanels connected directly together along and separated by a fold line, one of the subpanels of the fourth corner panel connected directly to the second side panel along and separated by a fold line, and the other of the subpanels of the fourth corner panel connected directly to the first end panel along and separated by a fold line;

(j) a first tab-lock and counterbalancing handle panel defined by two subpanels connected directly together along and separated by a fold line, one of the subpanels of the first tab-lock and counterbalancing handle panel connected directly to the first corner panel along and separated by a fold line;

(k) a second tab-lock and counterbalancing handle panel defined by two subpanels connected directly together along and separated by a fold line, one of the subpanels of the second tab-lock and counterbalancing handle panel connected directly to the second corner panel along and separated by a fold line;

(l) a first lid panel connected directly to the first side panel;

(m) a second lid panel connected directly to the second side panel; and (n) a center handle panel defined by two subpanels connected directly together along and separated by a fold line, one of the subpanels of the center handle panel connected directly to the first lid panel along and separated by a fold line, the center handle panel having tabs located on opposite ends thereof;

(o) wherein the two subpanels of the first tab-lock and counterbalancing handle panel define a first two-ply handle for gripping the box at a first end of the box and the two subpanels of the second tab-lock and counterbalancing handle panel define a second two-ply handle for gripping the box at a second end of the box opposite to the first two-ply handle at the first end of the box, each of the first and second two-ply handles defining openings configured to receive fingers of a hand and a respective tab of the center handle panel; and (II) folding the box blank along a plurality of the fold lines to form the assembled box.

16. The method of claim 15, further comprising adhering a subpanel of the first corner panel and a subpanel of the fourth corner panel to the first end panel, and a subpanel of the second corner panel and a subpanel of the third corner panel to the second end panel.

17. A box blank for forming a box by folding along fold lines of the box blank defining panels therein, the box blank comprising:

(a) a bottom panel;

(b) a first end panel connected directly to the bottom panel;

(c) a second end panel located opposite the first end panel and connected directly to the bottom panel;

(d) a first side panel connected directly to the bottom panel;

(e) a second side panel located opposite the first side panel and connected directly to the bottom panel;

(f) a first corner panel defined by two subpanels connected directly together along and separated by a fold line, one of the subpanels of the first corner panel connected directly to the first side panel along and separated by a fold line, and the other of the subpanels of the first corner panel connected directly to the first end panel along and separated by a fold line;

(g) a second corner panel defined by two subpanels connected directly together along and separated by a fold line, one of the subpanels of the second corner panel connected directly to the first side panel along and separated by a fold line, and the other of the subpanels of the second corner panel connected directly to the second end panel along and separated by a fold line;

(h) a third corner panel defined by two subpanels connected directly together along and separated by a fold line, one of the subpanels of the third corner panel connected directly to the second side panel along and separated by a fold line, and the other of the subpanels of the third corner panel connected directly to the second end panel along and separated by a fold line;

(i) a fourth corner panel defined by two subpanels connected directly together along and separated by a fold line, one of the subpanels of the fourth corner panel connected directly to the second side panel along and separated by a fold line, and the other of the subpanels of the fourth corner panel connected directly to the first end panel along and separated by a fold line;

(j) a first tab-lock and counterbalancing handle panel defined by two subpanels connected directly together along and separated by a fold line, one of the subpanels of the first tab-lock and counterbalancing handle panel connected directly to the first corner panel along and separated by a fold line;

(k) a second tab-lock and counterbalancing handle panel defined by two subpanels connected directly together along and separated by a fold line, one of the subpanels of the second tab-lock and counterbalancing handle panel connected directly to the second corner panel along and separated by a fold line;

(l) a first lid panel connected directly to the first side panel;

(m) a second lid panel connected directly to the second side panel; and (n) a center handle panel defined by two subpanels connected directly together along and separated by a fold line, one of the subpanels of the center handle panel connected directly to the first lid panel along and separated by a fold line, the center handle panel having tabs located on opposite ends thereof;

(o) wherein the two subpanels of the first tab-lock and counterbalancing handle panel define a first two-ply handle for gripping the box at a first end of the box and the two subpanels of the second tab-lock and counterbalancing handle panel define a second two-ply handle for gripping the box at a second, opposite end of the box, the first and second two-ply handles defining openings configured to receive fingers and the tabs of the center handle panel.

18. The box blank of claim 17, wherein each of the first and second two-ply handles defines an elongate hand opening configured to receive fingers of a hand and defines an elongate tab opening configured to receive one of the tabs of the center handle panel; and wherein the hand opening and the tab opening of the first two-ply handle intersect each other, and wherein the hand opening and the tab opening of the second two-ply handle intersect each other.

19. The box blank of claim 17, wherein the subpanels of the first tab-lock and counterbalancing handle panel define notches that align when the subpanels are folded relative to each other to form the first two-ply handle, the aligned notches forming a recess for receiving and retaining the second lid panel on the first end of the box when the box is in a closed position; and wherein the subpanels of the second tab-lock and counterbalancing handle panel define notches that align when the subpanels are folded relative to each other to form the second two-ply handle, the aligned notches forming a recess for receiving and retaining the second lid panel on the second, opposite end of the box when the box is in the closed position.

20. The box blank of claim 17, wherein the subpanels of the first tab-lock and counterbalancing handle panel define notches that align when the subpanels are folded relative to each other to form the first two-ply handle, the aligned notches forming a recess for receiving and retaining the second lid panel on the first end of the box when the box is in a closed position; and wherein the subpanels of the second tab-lock and counterbalancing handle panel define notches that align when the subpanels are folded relative to each other to form the second two-ply handle, the aligned notches forming a recess for receiving and retaining the second lid panel on the second, opposite end of the box when the box is in the closed position.

21. A box comprising a single sheet of material folded along fold lines therein to define panels, the single sheet of material comprising a handle panel defining a handle including a tab on each of opposite ends of the handle; two lid panels; four corner panels; and only two tab-lock panels, each of the tab-lock panels being connected along a fold line directly to a single respective one of said corner panels; wherein each tab-lock panel is located at an opposite end of the box and defines an opening through which a respective said tab of the handle is received for locking of one of said lid panels in a closed position of the box without locking the other lid panel in the closed position of the box.

* * * * *